US006365853B1

(12) United States Patent
Frisch

(10) Patent No.: US 6,365,853 B1
(45) Date of Patent: Apr. 2, 2002

(54) DEVICE FOR ACTUATING AN ELECTRICAL SWITCH

(75) Inventor: Ralph Frisch, Mömbris (DE)

(73) Assignee: TRW Automotive Safety Systems GmbH & Co. KG, Aschaffenburg (DE)

( * ) Notice: Subject to any disclaimer, the term of this patent is extended or adjusted under 35 U.S.C. 154(b) by 0 days.

(21) Appl. No.: 09/359,820

(22) Filed: Jul. 23, 1999

(30) Foreign Application Priority Data

Jul. 24, 1998 (DE) ..... 298 13 239

(51) Int. Cl.[7] ..... H01H 9/00
(52) U.S. Cl. ..... 200/61.55; 280/731
(58) Field of Search ..... 200/61.55, 5 A; 280/731

(56) References Cited

U.S. PATENT DOCUMENTS

| | | | | |
|---|---|---|---|---|
| 2,728,827 A | | 12/1955 | Towle | |
| 3,838,236 A | | 9/1974 | Wolf et al. | |
| 4,612,425 A | | 9/1986 | Kanai et al. | |
| 4,742,192 A | | 5/1988 | Levine et al. | |
| 5,085,462 A | | 2/1992 | Gualtier | |
| 5,308,106 A | | 5/1994 | Heidorn | |
| 5,401,922 A | * | 3/1995 | Asta | 200/5 A |
| 5,499,841 A | * | 3/1996 | Trojan et al. | 280/731 |
| 5,575,498 A | * | 11/1996 | Elqadah et al. | 280/731 |
| 5,588,673 A | * | 12/1996 | Green et al. | 280/731 |
| 5,684,283 A | * | 11/1997 | Hambleton, Jr. et al. | 200/61.08 |
| 5,762,853 A | * | 6/1998 | Harris et al. | 264/254 |
| 5,836,609 A | * | 11/1998 | Coleman | 280/728.3 |

FOREIGN PATENT DOCUMENTS

| | | |
|---|---|---|
| DE | 3506332 | 8/1985 |
| DE | 3248607 | 4/1988 |
| DE | 4034539 | 2/1991 |
| DE | 4133007 | 4/1992 |
| DE | 4410041 | 9/1994 |
| DE | 19507753 | 9/1996 |
| EP | 0088132 | 3/1983 |
| FR | 2745776 | 12/1997 |
| GB | 2134714 B2 | 8/1984 |

OTHER PUBLICATIONS

Klik Key Standard Kontaktmodule.

* cited by examiner

*Primary Examiner*—P. Austin Bradley
*Assistant Examiner*—Nhung Nguyen
(74) *Attorney, Agent, or Firm*—Tarolli, Sundheim, Covell, Tummino & Szabo L.L.P.

(57) ABSTRACT

A device for closing an electrical switch, for installation in a steering wheel of a motor vehicle is disclosed. The switch has a first contact element (1) which is essentially fixed, a second contact element (2) moveable against a return force, and an actuating means (6). The contact elements (1, 2) consist of elongated wire shaped or strip shaped material sections which are held parallel to one another within a spacer cage (3) at a defined distance from each other. Sections (4) of the cage (3) with fixed distance between the contact elements alternate, as seen in a longitudinal direction, with sections (5) where the second contact element (2) can be pressed against the first contact element (1) by means of the actuating means (6), accompanied by an elastic deformation of the material section of the second contact element (2).

8 Claims, 2 Drawing Sheets

DEVICE FOR ACTUATING AN ELECTRICAL SWITCH

The invention relates to a device for actuating an electrical switch, especially for the installation in the steering wheel of a motor vehicle, with one first essentially fixed contact element, and a second contact element that is moveable against a return force, and with an actuating means.

BACKGROUND OF THE INVENTION

Contact actuating devices of this type have been known for some time for the actuation of the horn switch in motor vehicles. They may be used in the same way for other applications, such as for the power-assisted opening and closing of the side windows or of the sliding sunroof. In the application sector of "motor vehicles" it is important that the contact device should function reliably over a long period of time, that is, it should establish the required electrical contact only when the driver depresses the contact device, and the contact should open again when the contact device is released by the driver. This requires a secure mounting of the involved contact elements in the open position, to avoid any unintended closure of the contacts on account of vibrations occurring in the vehicle. On the other hand, the moveable contact element must not be fixed so firmly in its open position that the closure of the contact will be possible only by exertion of a considerable force. Finally the contact separations should be realizable as small as possible so that the required contact closure is not unduly delayed by a long actuation stroke which would be unacceptable especially when attempting to sound the horn.

Furthermore, the required contact device has to be produceable as simple and cost-effective as possible and has to be adaptable to different often very space-limited installation conditions.

In order to meet these partly opposing limiting conditions, a device of the above-mentioned type is proposed characterized in that, according to the invention, the contact elements consist of elongated wire or strip shaped material sections which are held parallel to one another within a spacer cage at a defined distance from each other, sections with rigidly maintained distance between the elements alternating, as seen in a longitudinal direction, with sections where the second contact element can be pressed against the first contact element by means of an actuating device accompanied by an elastic deformation of the material section of the second contact element.

SUMMARY OF THE INVENTION

The invention relies on the fact that electrically conducting materials, in particular metals, are sufficiently elastic, when present in the form of wire or strip shaped starting material, to be deformable transverse to their longitudinal extension to the extent that the defined distances between the contacts can be bridged. When such material sections are held parallel to, and at a defined distance from each other, within a spacer cage, a contact device is obtained which may be embodied within widely varying limits with respect to the actuating force, the return force and the contact separation, since not only the sections of rigid distance maintenance and the sections capable of elastic deformation, provided according to the invention, may be varied in their longitudinal extension, but the cross-section of the material sections, their material specifications and their elastic properties are also variable. The elastic return force of such material sections remains virtually unchanged over the operating times usual for motor vehicles, so that on the basis of the once chosen design dimensions for both the spacer cage and the material sections an electrical contact device can be produced whose functional parameters do not change.

The constructional design of the contact device according to the invention is very simple. It is just necessary to arrange two material sections within a spacer cage, so that at least one of the material sections is capable of being deformed transverse to its longitudinal extension to the extent that it can be pressed against the other material section when appropriately actuated. The material sections need not be further processed and require only a connection to the electrical supply system of the vehicle. The contact device according to the invention can be designed in any required length, and can therefore also be combined with actuating devices which encompass a plurality of point shaped actuators or a large-surface actuating area. The two material sections do not have to be arranged in a straight line; they may be arranged in any desired curved configuration, as long as they are bent in the same sense and are maintained parallel to and at the same distance from each other, and can be elastically deformed by the actuating device to the required extent transverse to their longitudinal extension. There is furthermore no need at all for the two material sections to have the same cross-sectional area or to consist of the same type of material. Essentially important is only that one of the two material sections is sufficiently elastic to allow it being pressed against and into contact with the other, possibly rigid, material section.

BRIEF DESCRIPTION OF DRAWINGS

Expedient and advantageous embodiments of the logic design covered by the invention are described in the subclaims 2 to 9. Further points of interest are explained in more detail with reference to the application examples illustrated in FIGS. 1 to 4, where

DETAILED DESCRIPTION OF THE INVENTION

Figure 1:
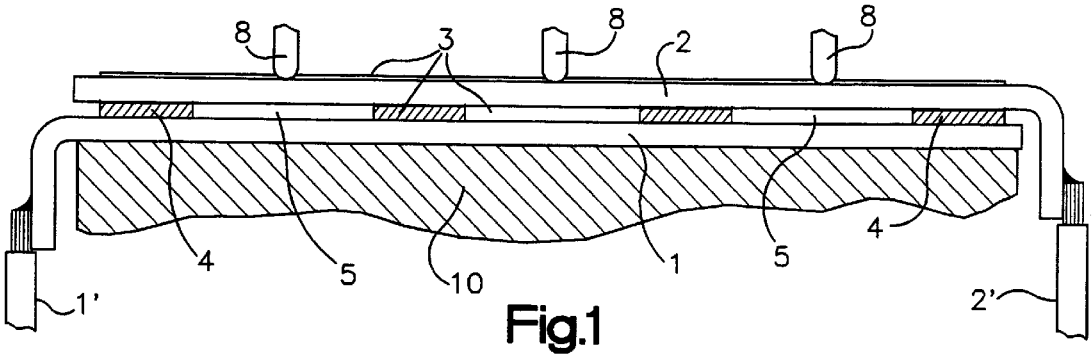
FIG. 1 shows a longitudinal cross section through a contact device according to the invention in a simplified representation.

In the representation according to FIG. 1, a first contact element 1 is held parallel to a second contact element 2, furthermore a spacer cage 3 is provided which alternating keeps the two contact elements 1, 2 at a distance from each other, zone 4, and allows the contact element 2 to approach the contact element 1 in the regions between zones 4, zone 5, when the elastically deformable contact element 2 is elastically deformed transverse to its longitudinal extension by means of an actuating device, which is shown in FIG. 1 as studs 8 that protrude in the direction of actuation. The contact elements 1, 2 consist of elongated wire or strip shaped material sections which are held parallel to one another within the spacer cage 3. The contact elements 1, 2 are connected to the two poles of an electrical circuit by means of the connections 1', 2'. Whenever the contact elements touch, the electric circuit is closed and the connected consuming device is switched on. As soon as the force initially applied by the actuating device is withdrawn, the contact element 2 automatically returns into the position shown. 10 denotes a support component on which the spacer cage 3 rests or which is connected to the spacer cage 3, respectively. The supporting component 10 may be a cup-shaped airbag housing with the spacer cage arranged outside of the top edge of the housing.

Figure 2A:
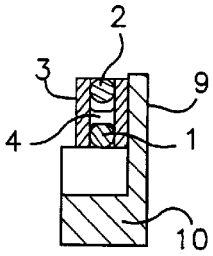
FIG. 2 shows a detail from FIG. 1 as a longitudinal cross section and as two cross sections.
Figure 2B:
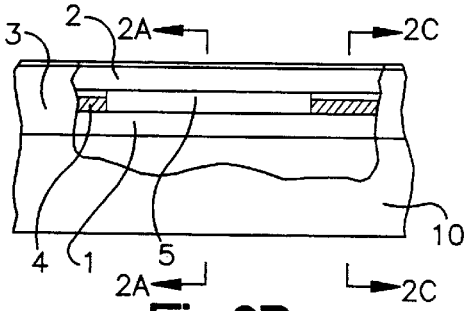
Figure 2C:
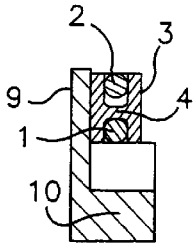

A possible embodiment of the spacer cage 3 can be inferred from FIG. 2, and in particular from FIGS. 2*a* and 2*c*. It has essentially an H-shaped section (FIG. 2*c*), the zones 4, as seen in the longitudinal direction, ensuring that the two contact elements 1, 2 are kept at a distance, alternately being either present or missing. Between these zones 4 zones 5 are provided (FIG. 2*b*) where the approach of the contact element 1 towards the contact element 2 is not hindered.

Figure 3A:
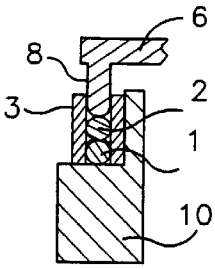
FIG. 3 shows a detail corresponding to FIG. 2 with the actuating element depressed.

The carrier element 10 has an upper edge 9 against which the spacer cage 3 abuts. Incidentally, zones at which the spacer cage 3 rests on the carrier element 10, as seen in a longitudinal direction, may alternate with such zones where a free space exists below the spacer cage (compare FIG. 2*a* with FIG. 3*a*).

The carrier device 10 can be, for example, an airbag housing with the spacer cage 3 positioned at its upper edge 9.

Figure 3B:
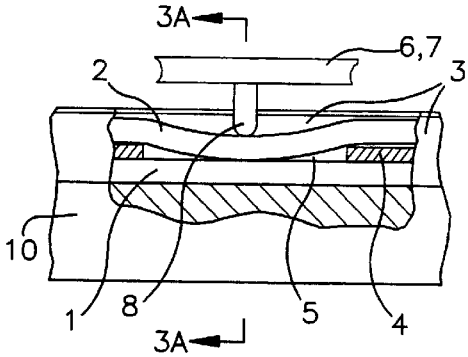

The embodiment according to FIG. 3 is shown in a short longitudinal section, as in FIG. 2, as well as in a cross section. In this particular case, the illustration is supplemented by the actuating device, which may be represented by the cover cap 7 of an airbag module housed within the steering wheel.

FIG. 3 illustrates a support component 10 with a continuous support for the spacer cage 3. Such an embodiment will be chosen when the contact element 1 is not to be subjected to any elastic deformation and therefore requires a back support which is continuous in the longitudinal direction. The actuating force is applied by means of an actuating device, which may be a cover cap 7 with studs 8 protruding in the direction of actuation, to the contact element 2 which is capable of elastic deformation transverse to its longitudinal extension between two zones 4 with rigid contact separation, as shown. The zones 5, where such an elastic deformation of the material section is possible, are adapted in their longitudinal extension to the cross section and the elastic properties of the second contact element 2.

Figure 4A:
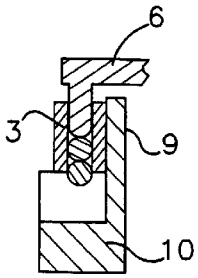
FIG. 4 illustrates an alternative to FIG. 3 with the actuating element depressed.
Figure 4B:
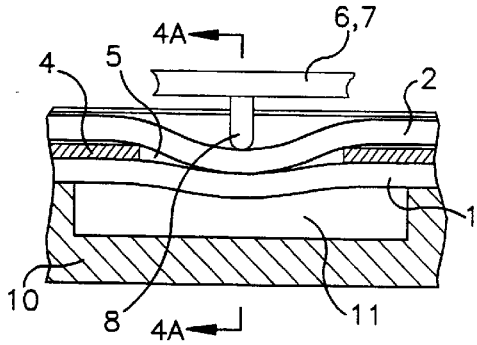

In the alternative illustrated in FIG. 4, all the reference figures have the same meaning as those of FIG. 3. Only the differences with respect to the embodiment according to FIG. 3 will be explained.

In this case, the support device 10 is not embodied as a continuous rigid back support but has one or more recesses 11 which permit an elastic yield of the first contact element 1. In this way, the elastic deformation of the contact element 1 may also be used to support the return of the contact element 2 and the actuating device, shown as a cover cap in FIG. 4. Furthermore, this design enhances the conveniency of the actuating device, since the contact pressure is not exerted against a rigid back support but against a resistance which is more or less resilient. Such an embodiment of the support device may also be chosen when the contact element 1, for the purpose of setting the desired contact distance, is held in the spacer cage, so that it will be irreversibly moved by a pre-determined amount at the first-time operation of the actuating device. This replacement of the contact element 1 takes place in the direction of actuation. The contact element is then taken along in the direction of actuation to the extent that the otherwise limited actuation stroke of the actuating device will allow. The contact element 1 will then be retained in this position within the spacer cage 3, whereby the desired contact distance is set at the same time.

Figure 5:
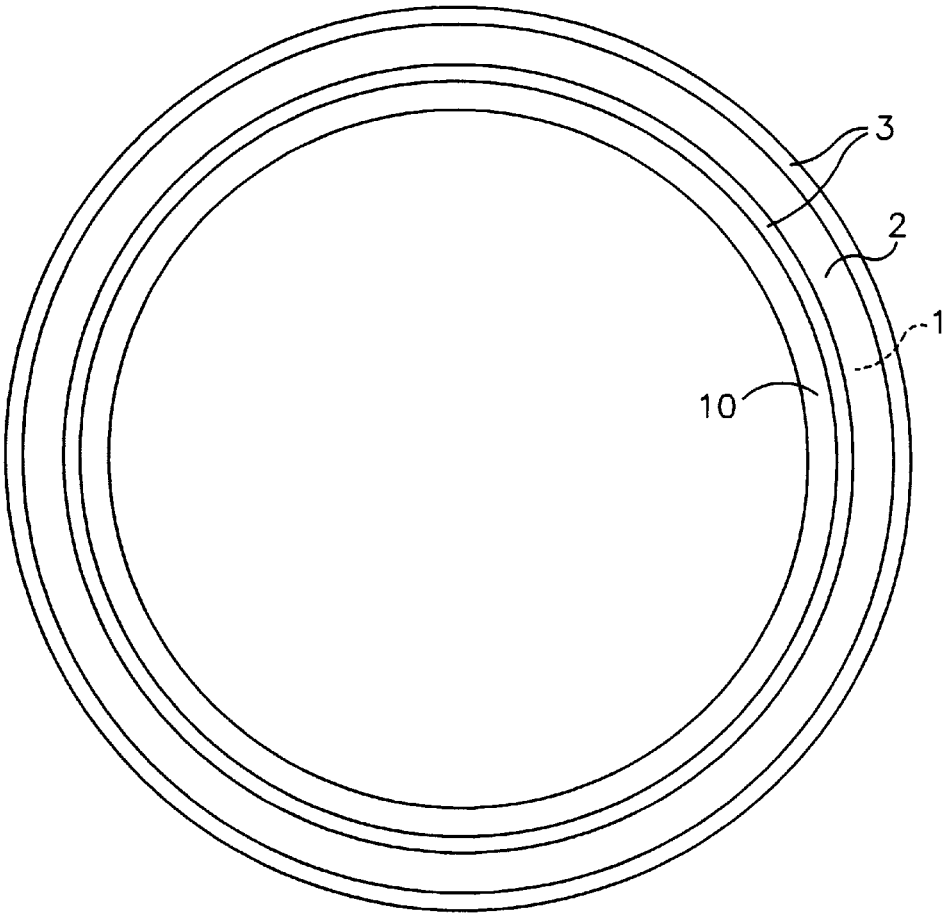
FIG. 5 shows a schematic plan view of an embodiment of the device.

FIG. 5 shows a schematic plan view of an embodiment of the device. In this embodiment, both the elongated wire or strip shaped material sections which form the contact elements 1, 2 and the spacer cage 3 have an annular shape. The annular shape allows the contact elements 1, 2 and the spacer cage 3 to be arranged outside the top edge of a cup-shaped airbag housing that is located in the hub of a steering wheel of a vehicle.

Figure 6:
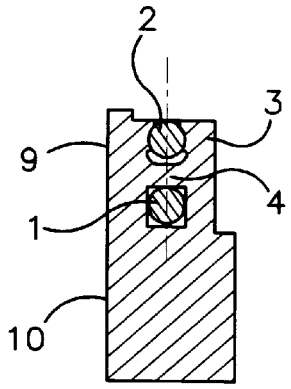
FIG. 6 shows a cross-section of an embodiment of the invention where the spacer cage is integrally molded into the support component.
Figure 7:
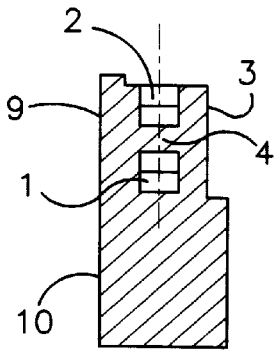
FIG. 7 shows a cross-section of an embodiment of the invention in which the spacer cage is integrally molded into the support component and the contact elements are formed of an elongated strip shaped material section.

FIG. 6 shows a cross-section of an embodiment of the invention where the spacer cage 3 is integrally molded into the support component 10. As with the previous embodiments, the support component 10 can be an airbag housing. If the support component 10 is an airbag housing, the actuating device 6 may be the cover cap 7 of the airbag module.

What is claimed is:

1. An electrical switch for use in a steering wheel of a motor vehicle, said switch comprising:

a first contact element which is essentially fixed;

a second contact element movable against a return force;

an actuating means; and a spacer cage defining a chamber, said first and second contact elements each consisting of an elongated wire shaped or strip shaped material section;

said spacer cage having two opposing wall sections located spaced apart from a each other by a fixed distance;

said material sections being located between said two opposing wall sections, and being held parallel to one another within said chamber solely by said two opposing wall sections and being spaced apart at a defined distance from each other;

said opposing wall sections of said spacer cage extending along said contact elements;

said opposing wall sections being connected to each other at spaced apart locations by spaced apart cage portions, said cage portions being located between said contact elements;

said actuating means extending into said chamber to engage at least one of said contact elements, said at least one of said contact elements being movable in said chamber and between said cage portions into contact with said other contact element by said actuating means moving in said chamber and elastically deforming said material section of said at least one of said contact elements.

2. The device according to claim 1, wherein said material section of said second contact element is such that a return force resulting from elastic deformation of said second contact element is also sufficient to return said actuating means.

3. The device according to claim 1, wherein said material section of said first contact element is supported in said spacer cage and is movable in the direction of movement of said actuating means.

4. The device according to claim 3, wherein said material section of said first contact element consists of a resilient material.

5. The device according to claim 3, wherein said material section of said first contact element is mounted within said spacer cage and is displaced irreversibly to achieve a defined contact distance.

6. The device according to claim 1, wherein said first and second contact elements and said spacer cage are held in an annular shape and positioned within a steering wheel in such a way that said second contact element can be pressed against said first contact element by means of said actuating means in approximately the direction of the steering wheel column axis.

7. The device according to claim 6, wherein a cover cap of an airbag module housed in the steering wheel serves as an actuating means said cover cap being provided with studs or similar elements protruding in the direction of actuation.

8. The device according to claim 7, wherein said first and second contact elements and said spacer cage are arranged adjacent a top edge of an airbag housing.

* * * * *